United States Patent [19]

Chen et al.

[11] 4,429,880

[45] Feb. 7, 1984

[54] GOLF GAME SIMULATOR DEVICE

[76] Inventors: Richard M. Chen, 51-25 Goldsmith St., Elmhurst, N.Y. 11373; Marvin Feldman, 788 Columbus Ave., New York, N.Y. 10025

[21] Appl. No.: 289,051

[22] Filed: Jul. 31, 1981

[51] Int. Cl.[3] ..... A63B 69/36

[52] U.S. Cl. ..... 273/176 FA; 273/185 D; 273/2

[58] Field of Search ..... 273/185 A, 185 B, 185 D, 273/176 FA, 185 R, 185 C, DIG. 28

[56] References Cited

U.S. PATENT DOCUMENTS

| | | | |
|---|---|---|---|
| 2,715,338 | 8/1955 | Simjian | 273/185 A |
| 2,737,393 | 3/1956 | Simjian | 273/185 A |
| 3,309,927 | 3/1967 | Ferranti | 273/185 A X |
| 3,659,284 | 4/1972 | Rusch | 273/85 G |
| 3,738,660 | 6/1973 | Branz et al. | 273/185 D |
| 3,769,894 | 11/1973 | Conklin | 273/185 A |
| 3,874,669 | 4/1975 | Ariano | 273/DIG. 28 |
| 4,192,510 | 3/1980 | Miller | 273/176 A |
| 4,304,406 | 12/1981 | Cromarty | 273/DIG. 28 |
| 4,343,469 | 8/1982 | Kunita et al. | 273/DIG. 28 |

FOREIGN PATENT DOCUMENTS

| | | | |
|---|---|---|---|
| 1397922 | 6/1975 | United Kingdom | 273/185 D |

OTHER PUBLICATIONS

"Golf Digest", Oct. 1980, pp. 48–53.

*Primary Examiner*—George J. Marlo
*Attorney, Agent, or Firm*—Lackenbach, Siegel, Marzullo, Presta & Aronson

[57] ABSTRACT

A game simulator device permits the golf player to view a specific golf course or portion thereof on a television monitor and is provided with additional information relating to the lie of ball and its position in relation to the hole. The golfer then hits the ball in the normal manner, which ball is fixedly retained on a joystick apparatus, whereby in striking the ball the joystick transmits signals to a computer which generates graphic data relative to a golf course and converts the signal input to graphic display information relative to the new position or lie of the ball in relation to the hole on the golf course. The golf ball is mounted so that when struck, first and second signals for each of four degrees of movement are transmitted to the computer and correlated with the golf course data input. The device in one embodiment utilizes a video disc whereby the course layout is pictorially viewed on a television monitor in addition to graphic information, and the computer determines the pictorial scene to be displayed depending upon the location of the golf ball after being struck by the golfer. The device is useful to simulate other ball games, such as billiards, pool or croquet.

18 Claims, 4 Drawing Figures

GOLF GAME SIMULATOR DEVICE

FIELD OF THE INVENTION

This invention relates to game simulators.

BACKGROUND AND DISCUSSION OF PRIOR ART

Heretofore it was known to tether a golf ball so as to obtain feedback from the ball during part of the ball flight, as disclosed in Simjian I, U.S. Pat. No. 2,715,338, granted Aug. 16, 1955. This device did not provide a realistic environment relative to the ball flight, and further did not provide responsive signals until the tether was taut.

In an effort to provide improved devices, a golf ball was struck by a club and driven in free, untethered flight against a screen or target, and often there was projection of a target or fairway, as generally disclosed in U.S. Pat. No. 3,759,528, issued Sept. 18, 1973 to Christophers; U.S. Pat. No. 2,581,738, issued Jan. 8, 1952 to E. E. Williams; U.S. Pat. No. 4,086,630, issued Apr. 25, 1978 to Speiser, et al; U.S. Pat. No. 4,150,825, issued Apr. 24, 1979 to Wilson; U.S. Pat. No. 3, 81,438, issued June 4, 1974 to Baron; U.S. Pat. No. 3,598,976, issued Aug. 10, 1971 to Russell; U.S. Pat. No. 3,559,996, issued Feb. 2, 1971 to Hopp; U.S. Pat. No. 3,729,315, issued Apr. 24, 1973 to Conklin I; U.S. Pat. No. 3,769,894, issued Nov. 6, 1973 to Conklin II; U.S. Pat. No. 3,072,410, issued Jan. 8, 1963 to Simjian II; U.S. Pat. No. 2,778,645, issued Jan. 22, 1957 to Simjian III; U.S. Pat. No. 3,091,466, issued May 28, 1963 to Speiser; and Canadian Pat. No. 682,617, issued Mar. 24, 1964 to Speiser.

Such prior art devices required extensive and elaborate arrangements to permit the flight of the ball against the target, and were not generally useful in homes or offices. Furthermore, such prior art devices could not generally accommodate putting, chipping and driving.

Such prior art devices either required the free flight of the ball in an elaborate chamber or the game did not provide a realistic aspect in stroking the ball or provide a high degree of accuracy as to the ball flight information.

Now there is provided by the present invention a game simulator in which the ball is struck in its normal intended manner and yet free flight or tethered flight is avoided, and yet there is an accurate determination and display of ball flight information in relation to a computer controlled images of the ball play environment.

It is therefore a principal object of the present invention to provide a game simulator in which highly accurate ball flight information is obtained and graphically displayed in relation to a specific play environment without requiring free flight of the ball after impact.

It is another object of the present invention to provide a game simulator as aforesaid in which a conventional television is utilized for display of the ball graphics as well as the golf course graphics.

It is another object of the present invention to provide a game simulator as aforesaid in which video images of actual courses may be displayed, and the ball movement information being accessed by the computer to determine the course position for viewing of the course position relative to the ball position, whereby the simulator permits "playing" of an actual course.

It is another object of the present invention to provide a game simulator which may be used in a home or office, utilizing a television set, and a home computer or game cassette computer, and video recorder or video disc player.

It is still a further object of the present invention to provide a game simulator as aforesaid which is useful for a broad range of games which the player impacts the ball in the normal intended manner.

DESCRIPTION OF THE PREFERRED EMBODIMENTS

Figure 1:
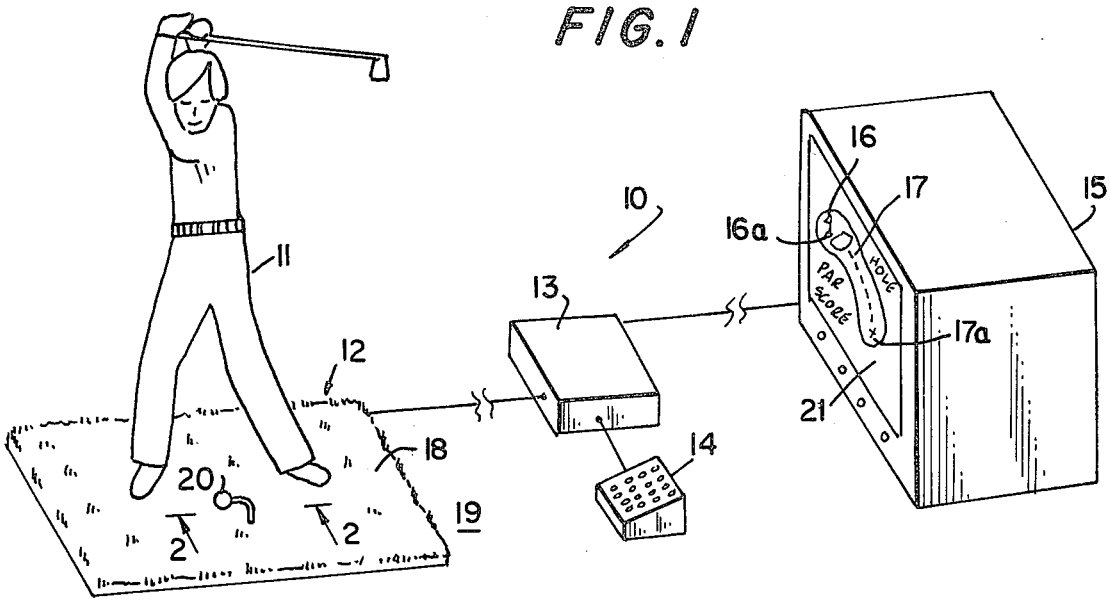
FIG. 1, is a perspective view of the golf simulator game of the present invention in use by a golfer.

Referring to FIG. 1, there is shown the golf simulator 10 of the present invention as being played by golfer or player 11. Simulator 10 comprises, in broad terms, ball data generating base 12, a computer 13 electrically interconnected to base 12 for data input from base 12, a course data input means (e.g., keyboard) 14 accessing said computer and a television set 15 for display of course information graphics 16 and ball information graphics 17 relative to the course information graphics. The player 11 stands on grass simulating surface (e.g. Astroturf) 18 to hold base 12 against the floor 19. The player then strikes ball 20 in its normal intended manner as dictated by the "position" of the ball location x 17*a* relative to the hole 16, as shown on television screen 21.

Figure 2:
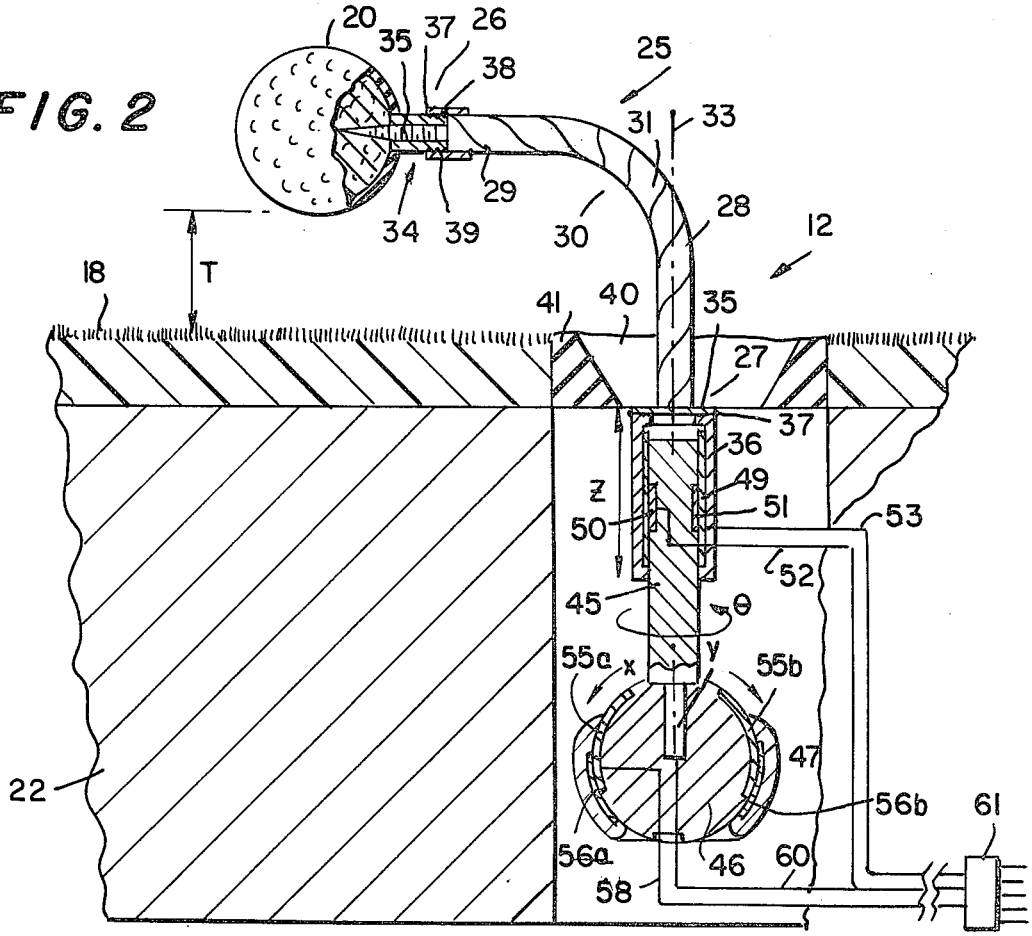
FIG. 2, is an enlarged partial sectional view taken along line 2—2 of FIG. 1.

Referring now specifically to FIG. 2, there is shown ball data generating base 12 which is formed of a wooden support platform 22 onto which is fixedly mounted plastic surface 18 so as to simulate a grass surface.

A ball mounting assembly 25 provides for mounting of ball 20 at end 26 and for mechanical-to-electrical conversion at end 27 of shaft 28. Shaft 28 is formed of a rigid metal, and has a first member 30 having a top horizontal portion 29, a middle curved or arcuate portion 31 and a straight vertical portion; reference also being made to axis 33 of the vertical portion for purposes hereinafter appearing. A ball mounting assembly 34 is attached at shaft portion 29, which assembly 34 comprises a ball attachment element or screw 35 which is screwed into the ball 20 itself. Screw 35 is formed with annular collar 37 with internal screw threads 38 for engaging external threads 39 of shaft portion 29. With the ball secured to screw 35, the assembly 34 is then fixedly and rigidly secured to the shaft by collar 37, by well known securing means.

Shaft portion 32 extends downwardly through hole 40 formed in top surface 18. An annular bevelled rubber ring 41 is fixedly secured within hole 40, so that movement of shaft portion 32 is bumpered and protects the shaft and board surface 18. Shaft portion 32 is fixedly mounted or welded to plate 35. A tubular sleeve 36 is welded to plate 35 as at 37. Sleeve 36 is slidably and rotatably mounted on second shaft 45 at the top end of shaft 45. That is, tubular sleeve 36 is movable in the z direction and in the angular theta direction with respect of shaft axis 33. A stop (not shown) may be provided to limit the upward movement of sleeve 36. A ball 46 is fixedly secured to shaft 45 at the lower or bottom end of the shaft. Ball 46 is mounted in socket 47 so that shaft 45 and in turn, shaft portion 28 is free to move in the x and y directions with respect to axis 33. In this manner, four degrees of movement are permissible with respect to shaft axis 33.

An electrically conductive contact collar 49 is fitted to the inside of tubular sleeve 36, which collar electrically contacts response brush elements 50 and 51, whereby relative z coordinate movement generates an electrical signal at 50 through wire 52, and relative theta coordinate movement generates an electrical signal at 51 through wire 53. Electrical contact strips 55*a* and 55*b* are recessed mounted in ball 46, which strips electrically contact elements 56*a* and 56*b* to generate a signal relative to x coordinate movement, which signal is transmitted through wire 58. Similarly, two strips (59*a* only being shown), disposed at 90° to strips 55*a* and 55*b*, generate signals relative to y coordinate movement, which signal is transmitted through electrical wire 60. All four coordinate movement signals are transmitted through the respective wires to multi-pin connector 61 for interface with computer 13.

It is to be noted that the height of ball 20 may be adjusted by initial movement of shaft 30, so that for driving the ball, the height is tee level as designated by letter T, whereas for chipping or putting, the ball may be rested on surface 18 as at 52*a*, as shown in the broken line view of FIG. 2. Initial setting of the height of the ball between T and 52*a*, sets a new reference point for the z coordinate. After such placement of the ball, a set or reset button (not shown) may be provided to set the computer for the oncoming impact. The set or reset button will also insure against inadvertent movement of the ball prior to the next impact.

With impact of the ball, the shaft moves in the four coordinate directions and signals are transmitted as aforesaid. The differences for each coordinate movement (x, y, z and theta) provides the impact data to the computer. The computer may, in turn, be programmed to compute the inpact data to determine direction, speed, loft and spin, so as in turn, determine the ultimate position of the ball with respect to the hole. For various levels of sophistication, the computer may be programmed for fair average bounce, fair average green surface condition, or for specialized surface conditions. Keyboard 14 may be utilized for inputting these specialized parameters to computer 13. Computer 13 and keyboard 14 may be combined such as in Radio Shack TRS-80.

The program for the computer continuously reads using input commands relative to the positional values of the x-y-z and theta values; said values being binary digit numeral information from the analog-digital converter of the joystick interface circuit which may be part of the computer. The computer comprises real-time frame positional values with one or more previous positional values for x-y-z and angular orientation, and computer "flight" information for the ball, and generates graphic information relative to the ball "flight" information for display on the conventional television or television monitor.

Figure 3:
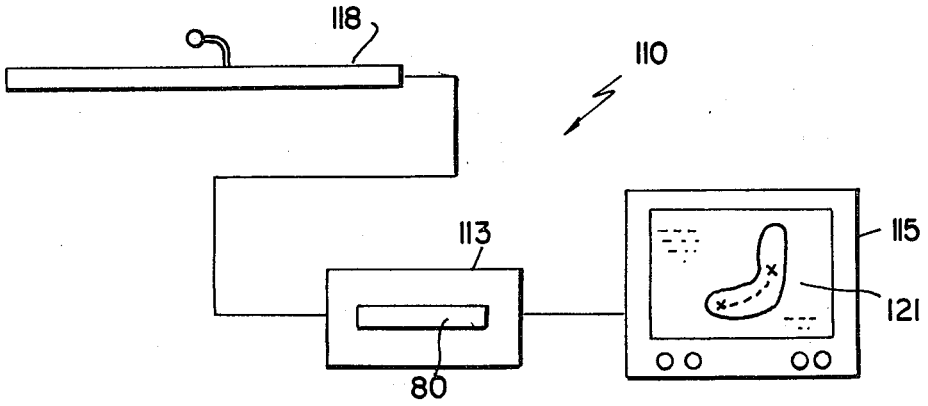
FIG. 3, is a schematic illustration of another embodiment of the golf simulator game.

Referring now specifically to FIG. 3, there is shown another embodiment of the invention, generally referred to as system 110. System 110 comprises a data generating base 118 and television 115, similar to respective base 18 and television 15, as afore-described. Computer 113 is of the game cassette type in which the cassette 80 includes the specific game program. An Atari ("Atari" is a trademark of Atari, Inc., Sunnyvale, Calif., a subsidiary of Warner Communications, Inc., New York, NY) game unit is a typical computer cassette of this type. In this manner of construction, the user selects the desired game cassette having the course information thereon and inserts cassette 80 into computer 113. Cassette 80 may include various golf course programs, such as information relating to actual courses, as well as contrived courses, both being of interest to the golf enthusiast. In addition, cassette 80 may contain a miniature golf course program, in which case only the putting mode of base 118 need be used.

Screen 121 will display graphic information relating to the golf course as generated by cassette 80, as well as graphic information relating to the position and lie of the ball, as well as positional changes generated by base 118, which graphics may be superimposed one on the other. In addition, the computer may display a running score and the score relationship to par for that selected course.

Figure 4:
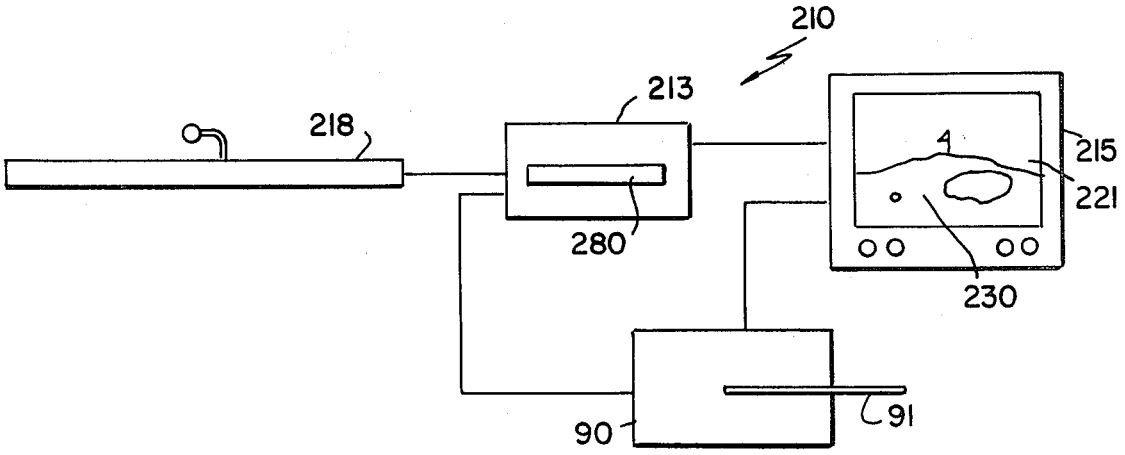
FIG. 4, is a schematic illustration of a further modification of the apparatus of FIG. 3.

In FIG. 4, there is shown a further embodiment of the system, which further embodiment is generally referred to as system 210. System 210 comprises a base 218, computer 213, cassette 280 and television 215, also similar in design and construction to units 118, 113, 80, and 115, respectively, as afore-described. System 210 further contains a video disc player 90 for playing disc 91. Player 90 receives input from computer 213 and selectively display video information, such as a video image of an actual golf course 230 on screen 221. Disc 91 and cassette 280 are of course coordinated so that generated images are of the same subject matter. In addition, the specific tee location or lie of the ball will have a corresponding view or pre-recorded scene on video disc 91. With the computer determined repositioning of the ball after impact, the computer may first generate graphic information relative to the lie of the ball and then instruct the video player to freeze frame the disc 91 to demonstrate the actual vantage point of the golfer as if the golfer were actually positioned on the course at that ball location. Pre-recorded images on the disc 91 may be at various point locations on the golf course spaced on a grid layout of several meters apart.

In utilizing the video disc player, it is important that the computer in accessing the video disc player be able to locate, skip to or jump to a specific point on the video disc so as to display a scene representative of the specific lie of the ball. A disc skip system useful in this regard is that as disclosed in U.S. Pat. No. 3,993,863, granted Nov. 23, 1976 to Leedom, et al.

In one aspect the present invention utilizes joystick construction elements to convert movement of the stick (i.e., ball mounting shaft) to electrical signals responsive to such movement. Typical joysticks representing such mechanical to electrical signal generation for game computer impact are shown in U.S. Pat. No. 4,245,137 issued Jan. 13, 1981 to Hirai; U.S. Pat. No. 3,935,669, issued Feb. 3, 1976 to potrzuski; U.S. 4,124,787, issued Nov. 7, 1978 to Aamoth; U.S. Pat. No. 4,091,234, issued May 23, 1978 to Bristow; and U.S. Pat. No. 4,181,827, issued Jan. 1, 1980 to Diepeveen. Of course, it is understood that the present joystick preferably provides four degrees of movement including x-y-z, as well as angular movement.

It is to be understood that while the preferred embodiment has been described with reference to golf, other ball or object games, wherein the ball or object is moved in response to an impact force are within the contemplation of the present invention. Suitable, other games by way of example, include, croquet, pool, billiards, baseball swing practice, and the like. In the pool game mode, the board surface will be that of a pool table and the mounted ball will be a cue ball. The computer program stores the ball number and location information, as well as the side wall and pocket geometry. Typically, the television screen will display a plan view of a pool table, but an auxiliary joystick may be utilized to develop auxiliary side views of the table for improved shot alignment by the player.

The computer is designed to provide graphic data of a particular game environment such as a golf course. The ball position or flight path information will generally be superimposed on the golf course display in a two-dimensional appearance. However, it is also within the contemplation of the invention to provide a simulation of three dimensional display of the ball flight or movement with respect to the golf course. Such three-dimensional video simulation may be achieved by utilization of the system disclosed in Rains, et al, U.S. Pat. No. 4,169,272, granted Sept. 25, 1979. A three-dimensional simulation in conjunction with a video disc player displaying scenes of an actual golf course, will provide a highly effective system for presenting a close simulation of actual play on the specific golf course recorded in the computer memory and on the video disc.

In addition to golf course play, the computer may generate graphics of novel golf play situations, as well as miniature golf courses.

It is also within the contemplation of the present invention to provide a data generating base wherein the cue ball can replace a golf ball, and the grass simulating surface be replaced by a pool table surface and a pool table cassette replace the golf course cassette. In this manner, several types of games may be played with the same basic equipment.

While the present embodiment described a specialized joystick design for accommodating a conventional golf ball, it is also to be understood that conventional joystick apparatus may be modified and interconnected with a clip-on type simulated golf ball.

The present system thus permits a video range of games, and game courses and game environments utilizing the same basic components, and wherein many of the components are generally available or presently owned by the user, namely, a television set, a game computer or home use computer and a video disc player or video tape player. The invention can then be readily implemented in many homes.

What is claimed is:

1. A golf simulator comprising:

means to mount a golf ball so that the ball can be struck by a golf club in putting, chipping, or driving; said mounting means comprising means to permit movement including upward movement of said mounting means in response to the impact of the club on said ball; means operably interconnected to said golf ball mounting means to actuate a first electrical signal responsive to the movement of the mounting means upon impact of the ball and a second electrical signal at a finite time after said impact; computer means to compute the difference in said signals so as to provide data for said ball as if the ball were in respective putting, chipping, or driving movement, said data including ball loft data from said signals for the said upward movement; means to input golf course data comprising fairway and green images to said computer so that said computer computes said golf course data and said golf ball putting, chipping or driving movement data; and visual display means to visually display the fairway and green images and the data for said golf ball being disposed on the fairway or green image.

2. The golf simulator game of claim 1, said mounting means comprising a pivot member, and means to fixedly attach said ball to one end of said member, and means to attach said movement permitting means to the other end of said member.

3. The golf simulator of claim 2, said member comprising a shaft being shaped so as to extend downwardly and away from said ball.

4. The golf simulator of claim 2, said means to permit movement comprising means to permit x-y-z coordinate movement relative to the axis of said shaft and rotational movement about said axis; and said means to actuate said signals further comprising means to actuate first and second signals for each coordinate movement and for said rotational movement, said upward movement mounting means comprising said z coordinate movement.

5. A golf simulator comprising: joystick means to permit an electrical signal in response to the joystick movement; means to fixedly mount a golf ball adjacent the top of said joystick means so that said joystick means can be moved when the ball is struck by the movement of a golf club head against the ball; computer means to access said signal and comprising means to convert said signal to video input information relative to the ball flight movement as if the ball was not fixedly mounted; a video monitor to display said ball flight information; video game information means being selectively removably insertable in said computer means, said information means comprising information for the graphic display of golf course information including a plurality of images of golf playing surfaces, said golf course information being one selected from golf course fairway and greens images, and miniature golf; and wherein said joystick means comprises means to permit upward movement of the joystick means for loft determination of the ball whereby the video monitor displays said golf course information, and said computer means comprising means to provide said ball movement information superimposed on said golf course information on said video monitor.

6. The golf simulator game of claim 5, said computer means comprising means to determine the lie of the ball from said movement information, and accessing said information means comprising memory storage means for golf course information related to the lie of the ball.

7. The golf simulator game of claim 6, said memory storage means comprising display means for video displaying information relative to the lie of the ball, and pictorial display means for video display of pictorial information relative to the lie of the ball.

8. The golf simulator of claim 7, said graphic display means comprising a video game cassette player and said pictorial display means comprising a video disc player and wherein said video monitor receives information input from said video cassette player and said video disc player.

9. The golf simulator of claim 5, said joystick comprising means for vertical adjustment in a first position whereat the ball is at tee height and in a second position wherein the ball is at putting height, further comprising grass surface simulating means, and wherein said ball touches said surface in said second position.

10. A data generating base and television display ball game simulator comprising: a support base, mounting means extending upwardly from said support base, and means to movably connect said mounting means to said support base; a ball, and means to fixedly mount said ball adjacent the top of said mounting means; said mounting means further comprising means to actuate an electrical signal in response to ball movement and in turn, the mounting means movement upon impact of the ball so as to generate a signal representing ball movement data; said mounting means comprising a shaft having a vertical portion having an axis and said means to connect said ball mounting means comprising means to permit x-y-z coordinate movement relative to the axis of said shaft, and rotational movement relative to the axis of said shaft, and said means to actuate a signal comprising actuation for each of the x-y-z and rotational movements; a television, and a video game computer spacedly disposed from said base and television, and being electrically connected to said television; and electrical connection means to connect said signal actuation means to the television connected game computer for computing said ball movement data to display the ball movement data on said television, said base being positionable relative to the disposition of said television and video game computer without moving said television or video game computer.

11. The data generating base of claim 10, said means to connect said mounting means comprising pivot means, whereby said pivot means pivots on impact of the ball.

12. The data generating base of claim 10, said support base comprising a top surface simulating the natural game surface for the ball, and said mounting means being formed so that the ball rests on said surface prior to impact.

13. The data generating base of claim 12, said mounting means comprising a shaft, said shaft being formed with a curved portion extending downwardly and away from said ball in the direction of ball movement.

14. The data generating base of claim 10, said mounting means comprising a shaft, said shaft being rigid so as to minimize flex upon impact of the ball so as to simultaneously move said ball and shaft.

15. The golf simulator of claim 1, further comprising a video disc player, and means to interconnect said video disc player to said visual display means and to said computer, a video disc selectively insertably removable in said video disc player, so as to provide golf course pictorial information on said visual display means.

16. The golf simulator of claim 5, said video game information means comprising a video game cassette.

17. A golf simulator comprising:

means to mount a golf ball so that the ball can be struck by a golf club in putting, chipping, or driving; said mounting means comprising means to permit movement of said mounting means in response to the impact of the club on said ball; means operably interconnected to said golf ball mounting means to actuate a first electrical signal responsive to the movement of the mounting means upon impact of the ball and a second electrical signal at a finite time after said impact; computer means to compute the difference in said signals so as to provide data for said ball as if the ball were in respective putting, chipping, or driving movement, said data including golf ball loft data from said signals from said movement; means to input golf course data comprising fairway and green images to said computer so that said computer computes said golf course data and said golf ball putting, chipping or driving movement data; and visual display means to visually display the fairway and green images and the golf ball data being disposed on the fairway or green image.

18. The golf simulator of claim 17, said means to permit movement comprising means to permit x-y-z coordinate movement relative to the axis of said shaft and rotational movement about said axis; and said means to actuate said signals further comprising means to actuate first and second signals for each coordinate movement and for said rotational movement, said golf ball loft data being computed from said z coordinate movement signal.

* * * * *